US007623088B2

(12) United States Patent
Brown

(10) Patent No.: US 7,623,088 B2
(45) Date of Patent: Nov. 24, 2009

(54) MULTIPLE FREQUENCY REFLECT ARRAY

(75) Inventor: Kenneth W. Brown, Yucaipa, CA (US)

(73) Assignee: Raytheon Company, Waltham, MA (US)

( * ) Notice: Subject to any disclaimer, the term of this patent is extended or adjusted under 35 U.S.C. 154(b) by 7 days.

(21) Appl. No.: 11/952,799

(22) Filed: Dec. 7, 2007

(65) Prior Publication Data

US 2009/0146907 A1 Jun. 11, 2009

(51) Int. Cl.
*H01Q 15/02* (2006.01)
*H01Q 1/38* (2006.01)

(52) U.S. Cl. ..... 343/909; 343/700 MS

(58) Field of Classification Search ..... 343/700 MS, 343/846, 909
See application file for complete search history.

(56) References Cited

U.S. PATENT DOCUMENTS 4,905,014 A 2/1990 Gonzales
6,020,853 A 2/2000 Richards
6,091,365 A * 7/2000 Derneryd et al. ..... 343/700 MS
6,396,449 B1 5/2002 Osterhues
6,744,411 B1 6/2004 Osterhues
6,795,020 B2 * 9/2004 Sreenivas et al. ..... 343/700 MS
6,885,355 B2 * 4/2005 Killen et al. ..... 343/909
6,900,763 B2 * 5/2005 Killen et al. ..... 343/700 MS
7,053,832 B2 * 5/2006 Manzione et al. ..... 343/700 MS
2004/0100343 A1 5/2004 Tsu
2007/0139247 A1 6/2007 Brown

FOREIGN PATENT DOCUMENTS

EP 1 120 856 8/2001
EP 1120856 8/2001

OTHER PUBLICATIONS

Malibu Research, Flaps Antenna Technology.

* cited by examiner

*Primary Examiner*—HoangAnh T Le
(74) *Attorney, Agent, or Firm*—SoCal IP Law Group LLP; Steven C. Sereboff; John E. Gunther

(57) ABSTRACT

There is disclosed a reflect array which may include a dielectric substrate having first and second surfaces. The second surface may support a conductive layer. A first array of conductive phasing elements and a second array of conductive phasing elements may be supported by the first surface. The first array may have a first pitch and the second array may have a second pitch different from the first pitch.

20 Claims, 8 Drawing Sheets

500

MULTIPLE FREQUENCY REFLECT ARRAY

RELATED APPLICATION INFORMATION

This application is related to pending application Ser. No. 11/750,292, filed May 17, 2007, entitled "Dual Use RF Directed Energy Weapon and Imager."

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to reflectors for microwave and millimeter wave radiation.

2. Description of the Related Art

Passive reflect arrays are arrays of conductive elements adapted to reflect microwave or millimeter wave radiation within a predefined frequency band. The radiation may be reflected with a phase shift that is dependent on the size, shape, or other characteristic of the conductive elements. The size, shape, or other characteristic of the conductive elements may be varied to cause a varying phase shift across the extent of the array. The varying phase shift may be used to shape or steer the reflected radiation. Reflect arrays are typically used to provide a reflector of a defined physical curvature that emulates a reflector having a different curvature. For example, a planar reflect array may be used to collimate a diverging microwave or millimeter wave beam, thus emulating a parabolic reflector.

DETAILED DESCRIPTION

Within this description, the term "shape" is used specifically to describe the form of two-dimensional elements, and the term "curvature" is used to describe the form of three-dimensional surfaces. Note that the term "curvature" may be appropriately applied to flat or planar surfaces, since a planar surface is mathematically equivalent to a curved surface with an infinite radius of curvature. The term "microwave" is used to describe the portions of the radio frequency spectrum above approximately 1 GHz, and thus encompasses the portions of the spectrum commonly called microwave, millimeter wave, and terahertz radiation.

The term "phase shift" is used to describe the change in phase that occurs when a microwave beam is reflected from a surface or device. A phase shift is the difference in phase between the reflected and incident beams. Within this description, phase shift will be measured in degrees and defined, by convention, to have a range from −180 degrees to +180 degrees. The term "phase shift pattern" is used to describe a designed variation in phase shift across the surface of a reflect array.

Description of Apparatus

Figure 1:
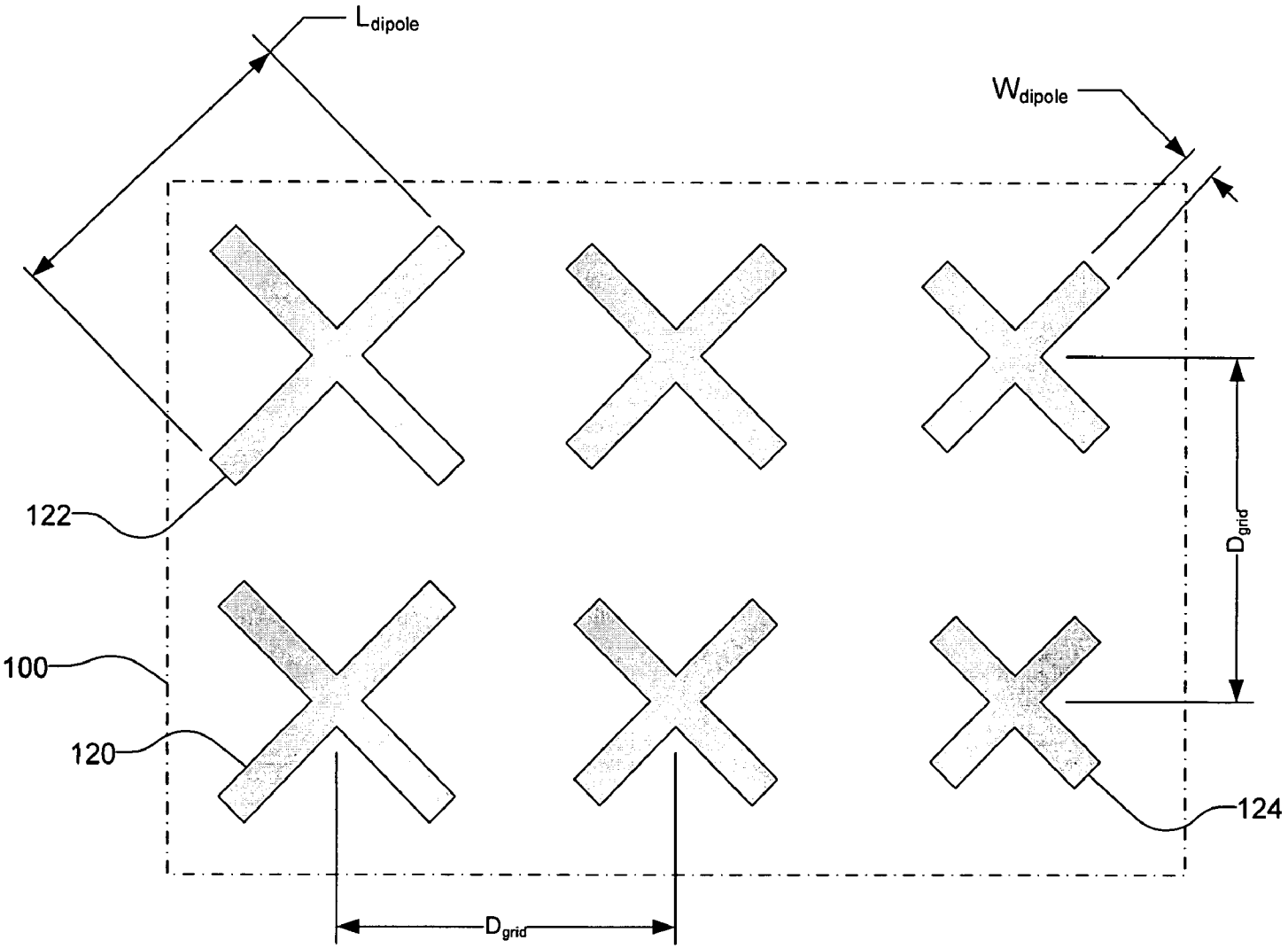
FIG. 1 Prior Art
FIG. 1 is a plan view of a reflect array.

Referring now to FIG. 1, a exemplary reflect array 100 may include a two-dimensional array or grid of conductive elements, such as conductive element 120. The dimensions and shape of each conductive element may determine the electrical phase shift induced when microwave radiation is reflected from the reflect array. Thus the conductive elements will be referred to herein as "phasing elements". The phasing elements may be disposed on a rectangular grid and the distance between adjacent rows and columns of phasing elements may be $D_{grid}$. In this description, the terms "rows" and "columns" refer to the elements of the reflect array as shown in the figures and do not imply any absolute orientation of the reflect array. The reflect array 100 may be adapted to reflect microwave radiation within a predetermined frequency band. The distance $D_{grid}$ may be less than one wavelength, and may be about 0.5 wavelengths, of the microwave radiation in the predetermined frequency band.

As illustrated in the exemplary reflect array 100, each phasing element may have an "X" shape, but the phasing elements may have other shapes. X-shaped phasing elements may operate as crossed dipole structures, and may be characterized by dimensions $L_{dipole}$ and $W_{dipole}$. At least one dimension of the phasing elements may be varied across the reflect array. In the exemplary reflect array 100, the dimension $L_{dipole}$ is varied between the rows and columns of the reflect array such that phasing element 122 has the largest value of $L_{dipole}$ and phasing element 124 has the smallest value of $L_{dipole}$.

Figure 2:
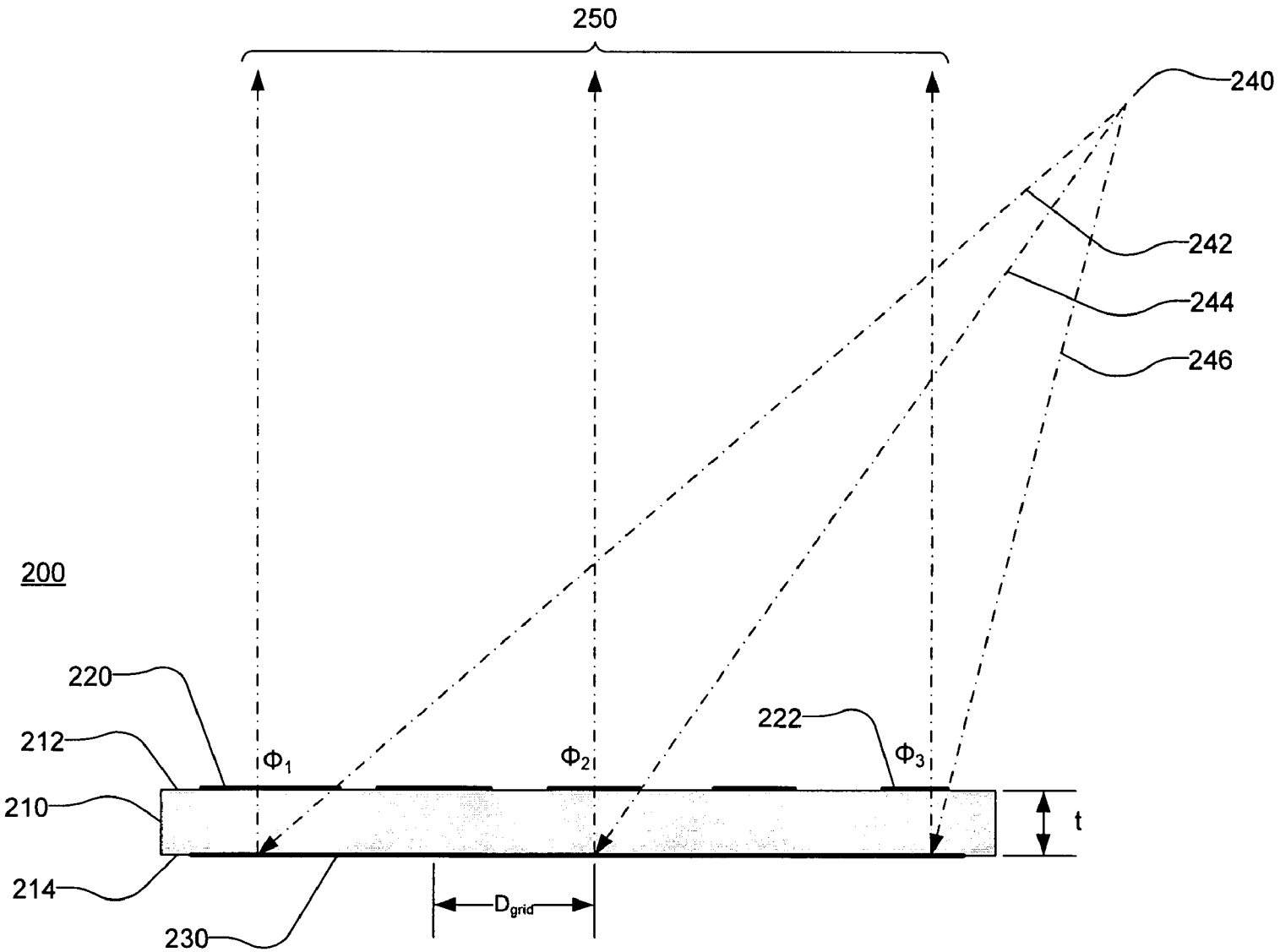
FIG. 2 is a side view of a reflect array.

Referring now to FIG. 2, a exemplary reflect array 200, which may be the reflect array 100 or another reflect array, may include a dielectric substrate 210 having a first surface 212 and a second surface 214. The dielectric substrate may be a ceramic material, a composite material such as DUROID® (available from Rogers Corporation), or some other dielectric material suitable for use at the frequency of interest. The dielectric substrate 210 may have a thickness t. The thickness t may be substantially less than one wavelength of the microwave radiation in the predetermined frequency band to prevent higher-order diffraction modes from being reflected by the reflect array. The thickness may be about 0.1 times the wavelength of operation of the reflect array.

The second surface 214 may support a conductive layer 230. The conductive layer 230 may be continuous over the second surface 214 and may function as a ground plane. The conductive layer 230 may be a thin metallic film deposited onto the second surface 214, or may be a metallic foil laminated to the second surface 214. The conductive layer 230 may be a metal element, such as a metal plate that may also function as a heat sink, bonded or otherwise affixed to the second surface 214.

The first surface 212 may support an array of conductive phasing elements such as element 220. The phasing elements may be formed by patterning a thin metallic film deposited onto the first surface 210, or by patterning a thin metallic foil laminated onto the first surface 210, or by some other method.

At least one dimension of the phasing elements may be varied across the reflect array 200. In the example of FIG. 2, the length of the phasing elements is varied such that phasing element 220 is longer than phasing element 222. The variation in the dimension of the phasing elements may result in a variation of the phase of microwave radiation reflected from the reflect array 200. For example, incident microwave radiation 242 may be reflected with a phase shift of $\phi_1$, incident microwave radiation 244 may be reflected with a phase shift of $\phi_2$, and incident microwave radiation 246 may be reflected with a phase shift of $\phi_3$. The phase shift pattern across the reflect array 200 may redirect and/or change the wavefront of the reflected microwave radiation. In the example of FIG. 2, incident microwave radiation 242, 244, 246 may be portions of a spherical wave emanating from a point source 240. The reflected wavefront 250 may be a plane collimated wavefront. Thus, in the example of FIG. 2, the planar reflect array 200 may emulate the optical characteristics of an off-axis parabolic reflector. In general, the phase shift pattern across the reflect array may result in a reflected wavefront that is not a specular reflection of the incident wavefront.

It should be understood that the exemplary reflect array 200 is a bidirectional device also capable of focusing a collimated input beam to a point.

By designing the appropriate phase shift pattern across the extend of a reflect array, a reflect array having a first curvature may be adapted to emulate the optical characteristics of a reflector having a second curvature different from the first curvature. A planar reflect array may be adapted to emulate a parabolic reflector, a spherical reflector, a cylindrical reflector, a torroidal reflector, a conic reflector, a generalized aspheric reflector, or some other curved reflector. A reflect array having a simple curvature, such as a cylindrical or spherical curvature, may be adapted to emulate a reflector having a complex curvature such as a parabolic reflector, a torroidal reflector, a conic reflector, or a generalized aspheric reflector.

Figure 3:
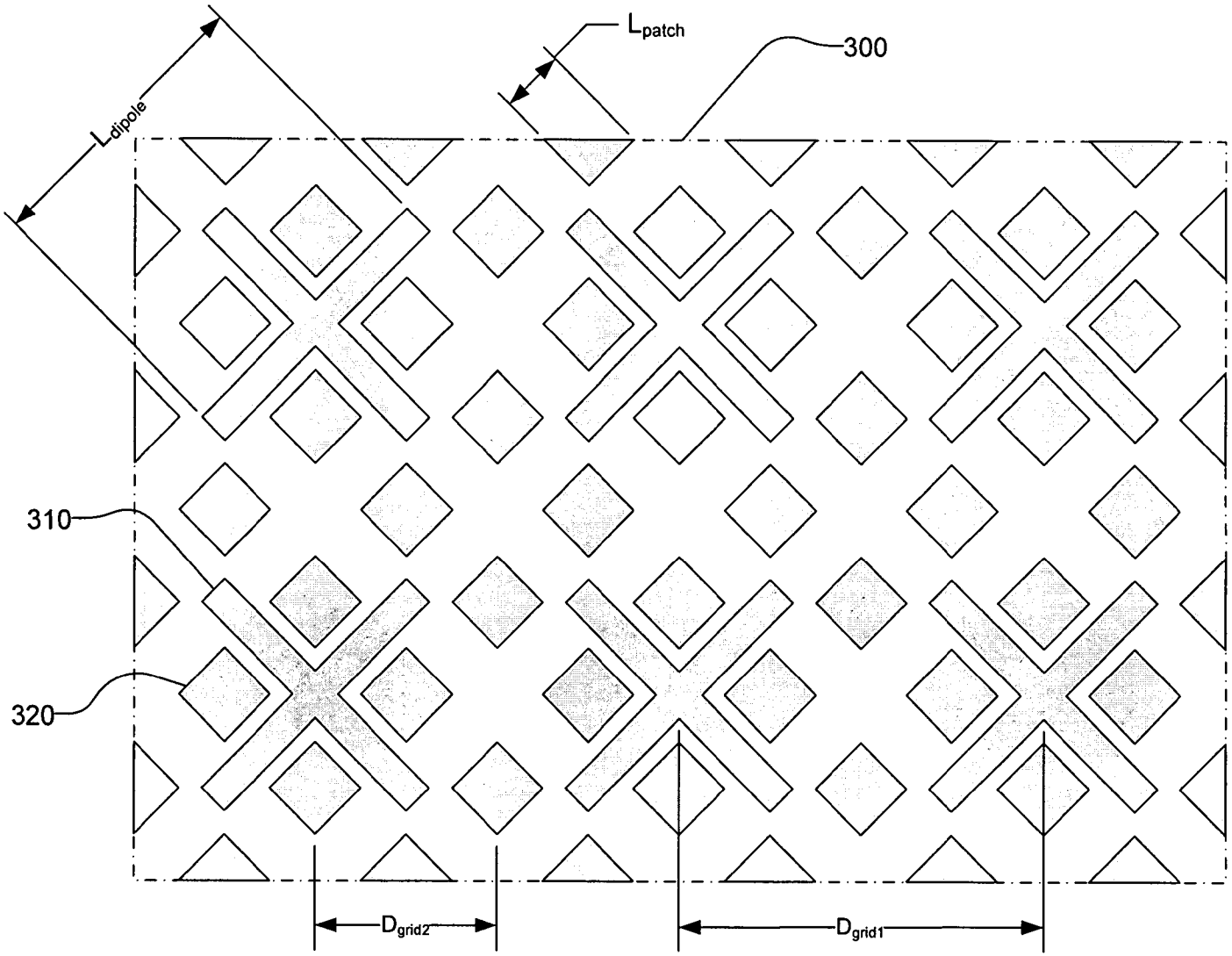
FIG. 3 is a plan view of a multiple frequency reflect array.

Referring now to FIG. 3, an exemplary multiple frequency reflect array 300 may include a first array 310 of phasing elements and a second array 320 of phasing elements. The first array 310 of phasing elements may be disposed on a rectangular grid and the distance between adjacent rows and columns of phasing elements may be $D_{grid1}$. The first array 310 of phasing elements may be adapted to reflect microwave radiation within a predetermined first frequency band. The distance $D_{grid1}$ may be less than one wavelength, and may be about 0.5 wavelengths, of the microwave radiation in the first frequency band.

The second array 320 of phasing elements may be disposed on a rectangular grid interleaved with the first array 310 of phasing element such that the elements of the second array 320 are disposed in the interstitial spaces between the elements of the first array 310. The distance between adjacent rows and columns of the second array 320 of phasing elements may be $D_{grid2}$. The second array 320 of phasing elements may be adapted to reflect microwave radiation within a predetermined second frequency band. The distance $D_{grid2}$ may be less than one wavelength, and may be about 0.5 wavelengths, of the microwave radiation in the second frequency band.

The distance $D_{grid2}$ may be one-half of the distance $D_{grid1}$, as shown in FIG. 3. However, having $D_{grid2}=0.5\ D_{grid1}$ does not imply that the second frequency band must have a frequency twice that of the first frequency band.

As illustrated in the exemplary reflect array 300 of FIG. 3, each phasing element in the first array 310 may have an "X" shape. The X-shaped phasing elements may operate as crossed dipole structures, and may be characterized by dimensions $L_{dipole}$ and $W_{dipole}$. Each phasing element in the first array 310 may be a cross shape, a square or diamond patch shape, or another shape.

Each phasing element in the second array 320 may have a diamond patch shape as illustrated in FIG. 3. The phasing elements in the second array 320 may have a square or round patch shape, an X or cross shape, or another shape. In the exemplary reflect array 300, each phasing element in the second array 320 may be characterized by a dimension $L_{patch}$.

The phasing elements in the first array 310 and the second array 320 may have the same or different shapes, and may be any shape that allows control of the phase of microwave radiation reflected from the reflect array 300.

The dimensions and shape of the phasing elements in the first array 310 and second array 320 may collectively determine the phase shift pattern induced when microwave radiation is reflected from the reflect array 300. At least one dimension of the phasing elements in either or both of the first array 310 and the second array 320 may be varied across the reflect array.

Figure 4:
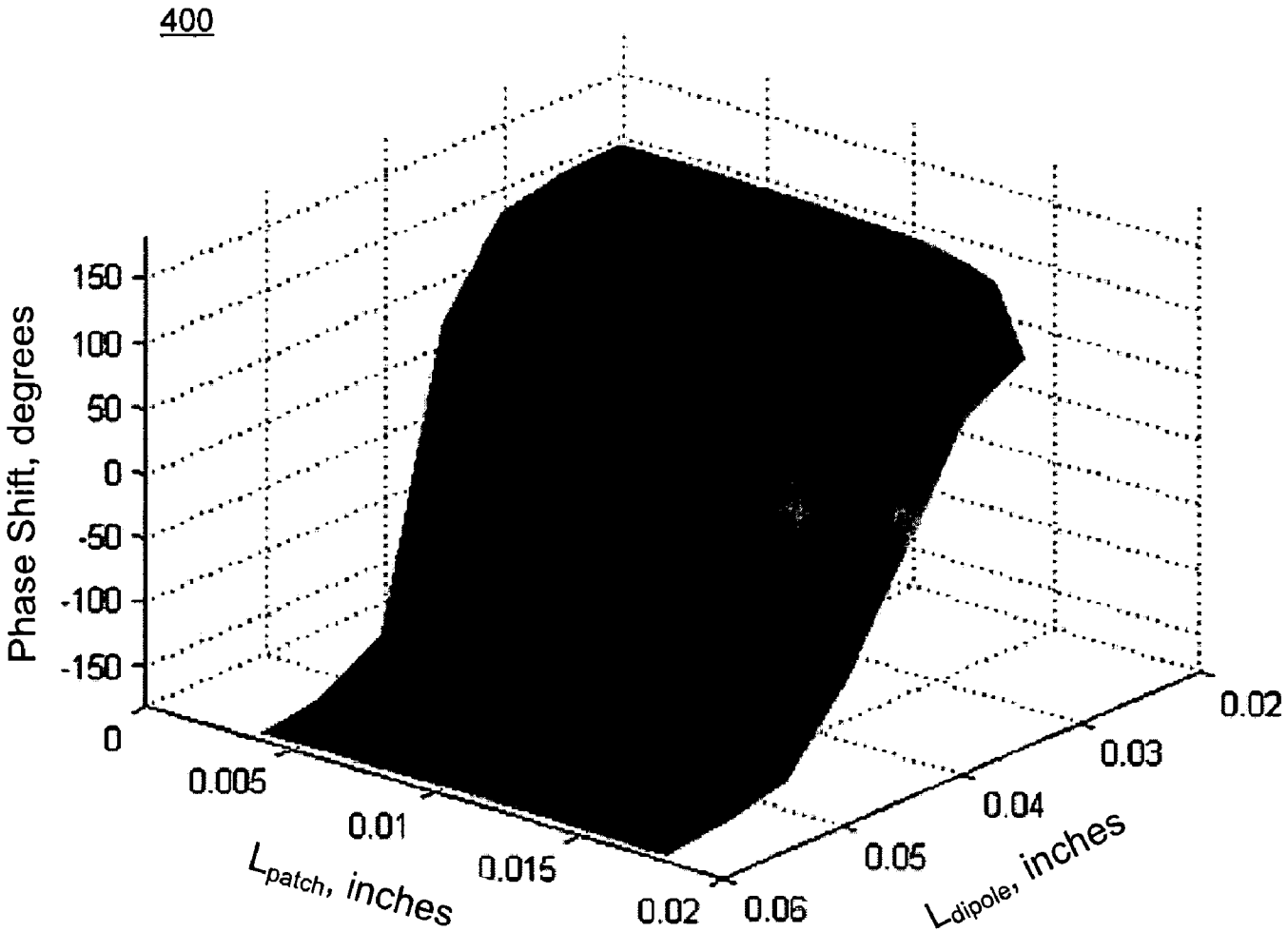
FIG. 4 is graphical representation of simulation results showing the reflection phase of a multiple frequency reflect array at a first frequency.
Figure 5:
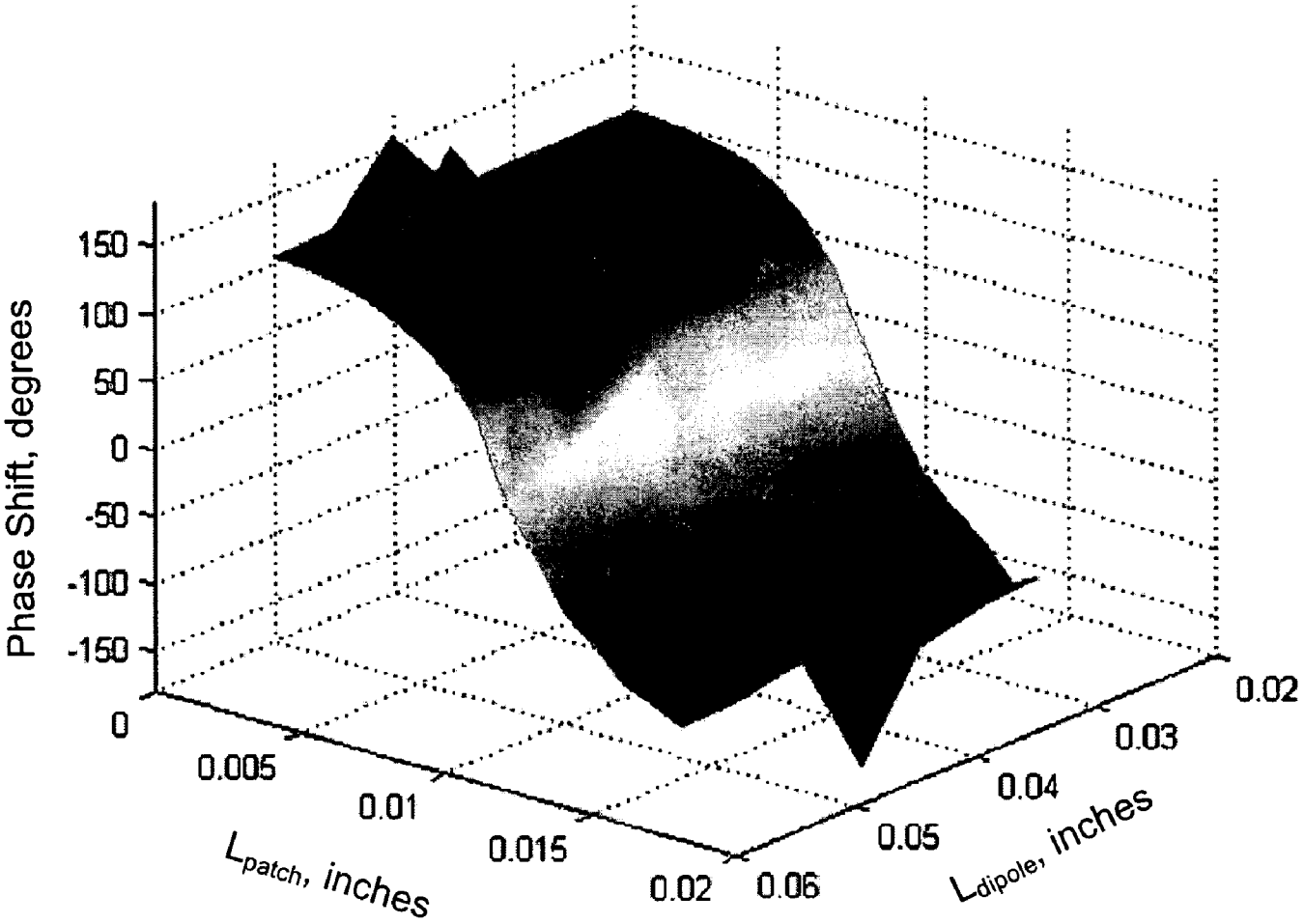
FIG. 5 is graphical representation of simulation results showing the reflection phase of a multiple frequency reflect array at a second frequency.

FIG. 4 and FIG. 5 show graphs 400/500 summarizing the simulated performance of a reflect array, which may be the reflect array 300, for a first frequency band and a second frequency band, respectively. The graphs 400/500 shows the dependence of phase shift on the dimensions $L_{patch}$ and $L_{dipole}$, where $L_{dipole}$ is the length along the arms of X-shaped crossed dipoles in a first array of phasing elements, and $L_{patch}$ is the length of the edges of square patches in a second array of phasing elements.

Referring now to FIG. 4, the graph 400 shows that the phase shift for the first frequency band is highly dependent on the dimension $L_{dipole}$. Moreover, the phase shift for the first frequency band is relatively independent of the dimension $L_{patch}$ for values of $L_{patch}$ less than or equal to 0.015 inches.

Referring now to FIG. 5, the graph 500 shows that the phase shift for the second frequency band is highly dependent on the dimension $L_{patch}$. Moreover, the phase shift for the second frequency band is relatively independent of the dimension $L_{dipole}$ except for values of $L_{dipole}$ near 0.050 inches.

By appropriate selection of the dimensions of the elements in the first array of phasing elements and the second array of phasing elements, the multiple frequency reflect array may provide different phase shift patterns for the first frequency band and the second frequency band. By designing the appropriate phase shift pattern across the extend of a reflect array, a multiple frequency reflect array having a first curvature may be adapted to emulate the optical characteristics of a reflector having a second curvature for a first frequency band and to emulate the optical characteristics of a reflector having a third curvature for a second frequency band. One or both of the second and third curvatures may be different from the first curvature, and the second and third curvatures may be different from each other.

For example, a planar reflect array may be adapted to emulate a parabolic reflector, a spherical reflector, a cylindrical reflector, a torroidal reflector, a conic reflector, a generalized aspheric reflector, or some other curved reflector for at least one of the first and second frequency bands and a different curved or planar reflector for the other frequency band. A reflect array having a simple curvature, such as a cylindrical or spherical curvature, may be adapted to emulate a reflector having a complex curvature such as a parabolic reflector, a torroidal reflector, a conic reflector, or a generalized aspheric reflector for at least one of the first and second frequency bands.

Figure 6:
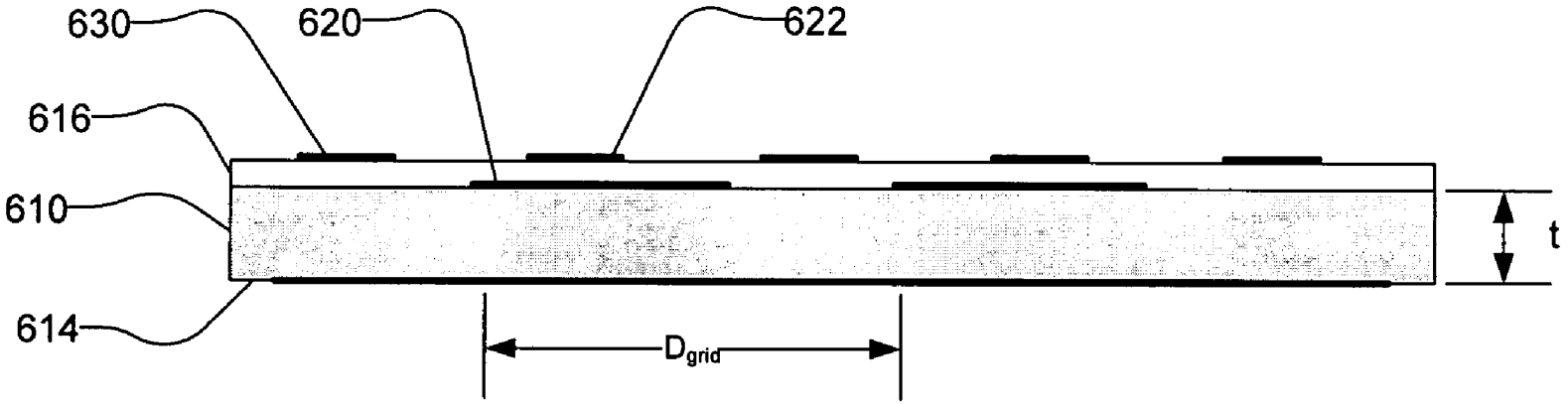
FIG. 6 is a side view of a variable phase reflect array.

A reflect array, such as reflect array 300, may be fabricated with the first array of phasing elements and the second array of phasing elements lying in a single layer supported by a dielectric substrate, as previously shown in FIG. 2. However, additional degrees of freedom, which may be useful to optimize the performance of the reflect array may be available if the first and second arrays of phasing elements are fabricated in different layers, as shown in FIG. 6. A reflect array 600 may include a dielectric substrate 610, which may support a conductive layer on a second surface 614. A first array of phasing elements 620 may be formed in a first conductive layer adjacent to the dielectric substrate 610. A second array of phasing elements 630 may be formed in a second conductive layer separated from the first conductive layer by a dielectric layer 616. The use of two conductive layers separated by a dielectric layer 616 may allow the elements of the first array 620 and the second array 630 to partially overlap, as shown at 622.

Figure 7A:
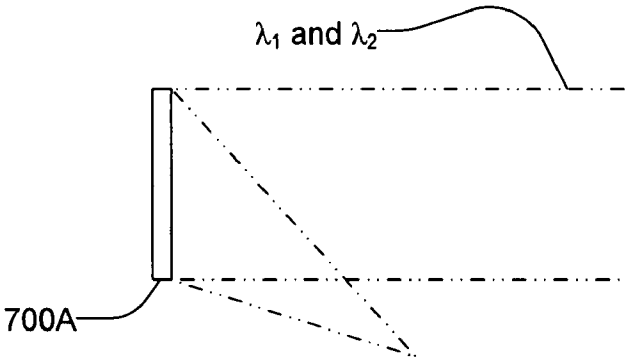
FIG. 7A is a side view of a multiple frequency reflect array having the same focal length and bend angle for two frequency bands.
Figure 7B:
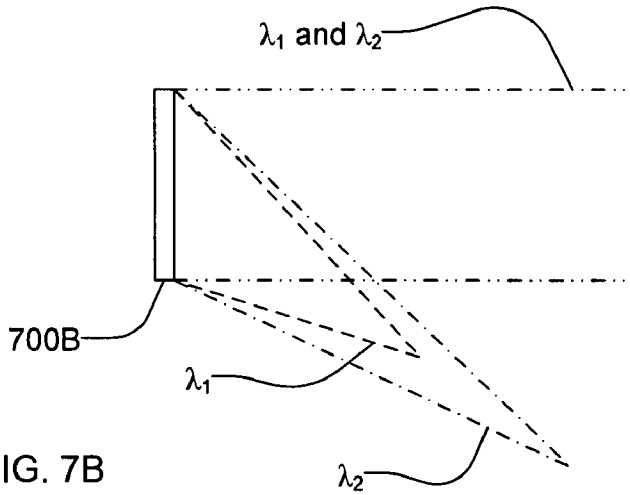
FIG. 7B is a side view of a multiple frequency reflect away having the same bend angle and different focal lengths for two frequency bands.
Figure 7C:
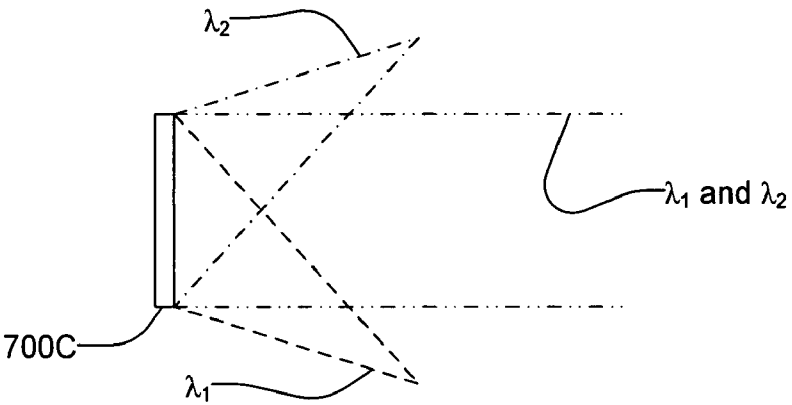
FIG. 7C is a side view of a multiple frequency reflect array having the same focal length and different bends angles for two frequency bands.

A multiple frequency reflect array may be used in a variety of applications where microwave beams in two or more frequency bands may be directed by a single element. FIG. 7A shows a multiple frequency reflect array 700A that has the same optical focal length and bend angle for a first frequency band $\lambda_1$ and a second frequency band $\lambda_2$. In this context, the term "bend angle" is the reflection angle of the axial ray of a beam. In this example, optical beams in both frequency bands may originate from a common point source (or two closely spaced points sources) and are collimated by the multiple frequency reflect array 700A. FIG. 7B illustrates a multiple frequency reflect array 700B that has different optical focal lengths but the same bend angle for the first frequency band $\lambda_1$ and the second frequency band $\lambda_2$. FIG. 7C illustrates a multiple frequency reflect array 700C that has the same optical focal length but different bend angles for the first frequency band $\lambda_1$ and the second frequency band $\lambda_2$.

Multiple frequency reflect arrays such as 700A, 700B, 700C, that form dual-frequency codirectional collimated beams may be useful in a variety of application including point-to-point communications. In this context, the term codirectional means that the axis of the collimated beam in the first frequency band is essentially parallel to the axis of the collimated beam in the second frequency bands. The two collimated beam may be coaxial.

Figure 7D:
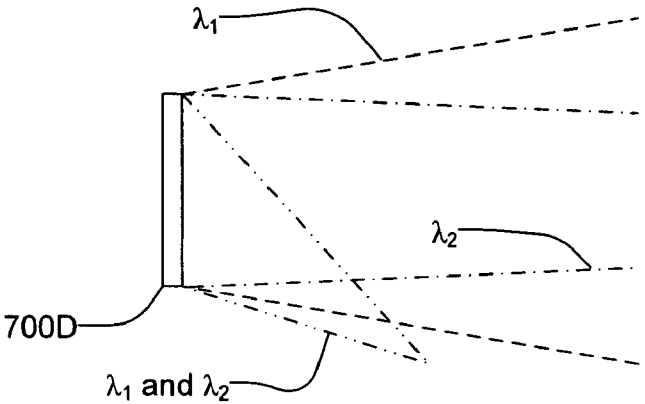
FIG. 7D is a side view of a multiple frequency reflect away having different focal lengths for two frequency bands.

FIG. 7D shows a multiple frequency reflect away 700D having different focal lengths for a first frequency band $\lambda_1$ and a second frequency band $\lambda_2$. In this example, optical beams in both frequency bands may originate from a common point source (or two closely spaced points sources) but are reflected differently from the multiple frequency reflect array 700D. The reflected beam at the second frequency band $\lambda_2$ may be a converging beam, and the reflected beam at the first frequency band $\lambda_1$ may be a diverging beam. The multiple frequency reflect array 700D may be useful as a beam director for a directed energy system, wherein a low power diverging microwave beam may be used to illuminate a scene to be viewed by an imaging sensor, and a high power non-diverging (collimated or converging) microwave beam may be used as a directed energy beam. The diverging and non-diverging beams may be coaxial.

Description of Processes

Figure 8:
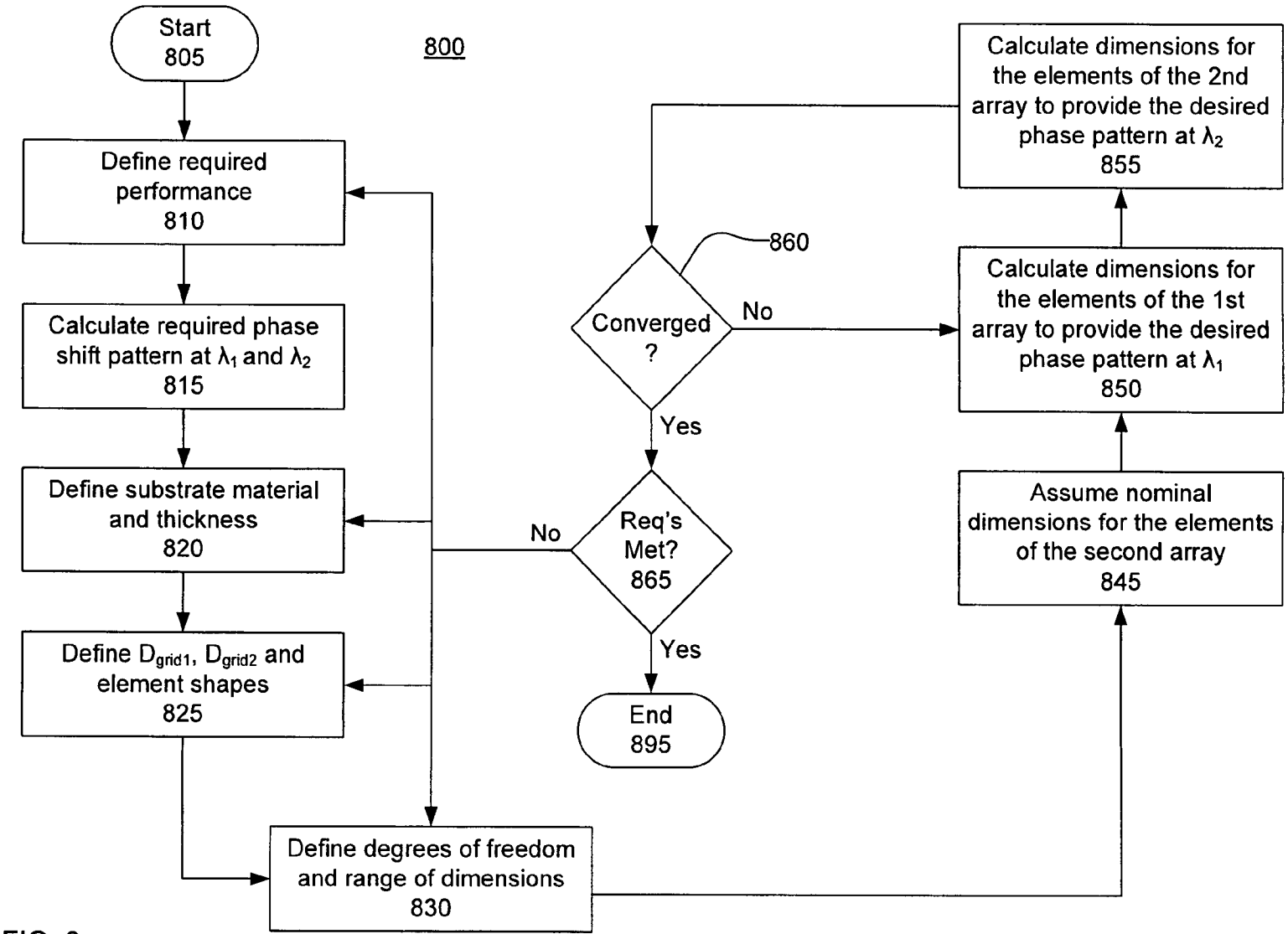
FIG. 8 is a flow chart of a process to design a multiple frequency reflect array.

Referring now to FIG. 8, a process 800 for designing a multiple frequency reflect array has both a start 805 and an end 895, but the process is cyclical in nature and may be repeated iteratively until a successful design is achieved. At 810 the required optical performance desired for the multiple frequency reflect array may be defined. For example, the defined performance may include converting a first incident beam in a first frequency band having a first wavefront into a first reflected beam having a third wavefront that is not a specular reflection of the first wavefront. The defined performance may also include converting a second incident beam in a second frequency band having a second wavefront into a second reflected beam having a fourth wavefront that is not a specular reflection of the second wavefront. The desired performance may also include definitions of the first frequency band and the second frequency band, and a maximum reflection loss. The multiple frequency reflect array may commonly be a component of a larger system and the desired performance of the multiple frequency reflect array may be defined in conjunction with the other components of the system.

At 815, the required reflection phase pattern, or reflection phase as a function of position on the reflect array, may be calculated for each of the first frequency band and the second frequency band based on the first, second, third, and fourth wavefronts defined at 810.

At 820, the substrate material and thickness may be defined. The substrate material and thickness may be defined based upon manufacturing considerations or material availability, or some other basis.

At 825, the grid spacing and phasing element shape may be defined for a first array of phasing elements and a second array of phasing elements. These parameters may be defined by assumption, experience, adaptation of prior designs, other methods, and combinations thereof.

At 830, the degrees of freedom (how many dimensions that are allowed to vary during the design process), and range of dimensions may be defined for the first arrays of phasing elements and the second array of phasing elements. These parameters may also be defined by assumption, experience, adaptation of prior designs, other methods, and combinations thereof. For example, the initial value for the length of the phasing elements in the first array may be set to less than $\lambda_1/2$, where $\lambda_1$ is the nominal wavelength of the first frequency band, and the initial value for the length of the phasing elements in the second array may be set to less than $\lambda 2/2$, where $\lambda 2$ is the nominal wavelength of the second frequency band.

At 845, each degree of dimensional freedom for the elements of the second array may be temporarily defined to be a predetermined nominal value, which may be the mid-point of the range of dimensions or some other value. For example, assume the elements of the second array are diamond-shaped patches and the length along the edges of the patches is free to vary over a range of 0.005 inches to 0.020 inches. In this example, at 845, the length of each patch element in the second array may be defined to be 0.125 inches.

At 850, simulation or other methods may be used to calculate the dimensions for the elements in the first array required to provide the desired phase shift pattern for the first frequency band.

At 855, simulation or other methods may be used to calculate the dimensions for the elements in the second array required to provide the desired phase shift pattern for the second frequency band, given the dimensions of the elements of the first array previously calculated at 850.

The calculations performed at 850 and 855 may be done iteratively until the design of the multiple frequency reflect array has converged. The initial calculations at 850 may be performed using the assumed dimensions of the second array previously from 845. Subsequent calculations at 850 may be done using actual dimensions for the elements of the second array as previously calculated at 855.

At 860, a determination may be made if the design has converged. The determination may be made by comparing the most recent results calculated at 850 and 855 with the previous results. The design may be considered as converged if the difference between two successive sets of results is negligible or within some predetermined small margin. The calculations at 850 and 855 may be repeated iteratively until the design has converged or for some predetermined maximum number of cycles.

If the design is converged, at 865, the simulated performance of the multiple frequency reflect array from 860 may be compared to the optical performance requirements defined at 810. If the design from 860 meets the performance requirements from 810, the process 800 may finish at 895. If the design from 860 does not meet the performance requirements from 810, the process may repeat from steps 810 (changing the optical performance requirements), from 830 (changing the substrate selection), from 825 (changing the grid spacing and/or element shapes) or from 830 (changing the degrees of freedom and/or range of dimensions) until the optical performance requirements have been satisfied.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A reflect array, comprising a dielectric substrate having a first surface and a second surface a conductive layer supported by the second surface a first array of phasing elements supported by the first surface a second array of phasing elements supported by the first surface wherein the first array has a first pitch and the second array has a second pitch different from the first pitch, and wherein at least a first dimension of the phasing elements in the first away is varied to cause a phase shift of energy reflected in a first frequency band to vary across the reflect array.

2. The reflect array of claim 1, wherein the elements of the second array are disposed in the interstitial spaces between the elements of the first array.

3. The reflect array of claim 2, wherein the elements of the first array are "X" shapes and the elements of the second array are square patches.

4. The reflect array of claim 1, wherein the second pitch is one-half of the first pitch.

5. The reflect array of claim 1, wherein the first array is adapted to reflect microwave energy within the first frequency band and the second array is adapted to reflect microwave energy within a second frequency band different from the first frequency band.

6. The reflect array of claim 5, wherein at least a second dimension of the phasing elements in the second array is varied to cause the phase shift of the energy reflected at the second frequency band to vary across the reflect array.

7. The reflect array of claim 6, wherein the elements of the first away have "X" shapes the first dimension is the length along the arms of the "X" shapes.

8. The reflect array of claim 6, wherein the elements of the second away have diamond shapes the second dimension is the length along the edges of the diamond shapes.

9. The reflect array of claim 6, wherein the dielectric substrate has a first curvature the phase shift for the first frequency band is varied across the reflect array to cause the reflect array to emulate a reflector having a second curvature different from the first curvature the phase shift for the second frequency band is varied across the reflect array to cause the reflect array to emulate a reflector having a third curvature different from the first curvature.

10. The reflect array of claim 9, wherein the third curvature is different from the second curvature.

11. The reflect array of claim 6, wherein the dielectric substrate is planar the reflect array emulates a curved reflector for at least one of the first and second frequency bands.

12. The reflect array of claim 11, wherein the reflect array emulates, for at least one of the first and second frequency bands, a curved reflector selected from the group consisting of a parabolic reflector, a spherical reflector, a cylindrical reflector, a torroidal reflector, a conic reflector, and a generalized aspheric reflector.

13. The reflect array of claim 6, wherein the reflect array has a first bend angle for the first frequency band and a second bend angle not equal to the first bend angle for the second frequency band.

14. The reflect array of claim 6, wherein the elements in the first array are configured to reflect microwave energy in the first frequency band from a first point source as a first collimated beam, and the elements in the second array are configured to reflect microwave energy in the second frequency band from a second point source as a second collimated beam codirectional with the first collimated beam.

15. The reflect array of claim 14, wherein the first and second collimated beams are coaxial.

16. The reflect away of claim 6, wherein the elements of the first array are configured to reflect microwave energy in the first frequency band from a first point source as a diverging beam, and the elements of the second away are configured to reflect microwave energy in the second frequency band from a second point source as a non-diverging beam.

17. The reflect array of claim 16, wherein the diverging beam and the non-diverging beam are coaxial.

18. The reflect array of claim 1, wherein the first array of phasing elements and the second array of phasing elements are formed from a single conductive layer.

19. The reflect away of claim 1, wherein the first away of phasing elements and the second away of phasing elements are formed from first and second conductive layers, respectively, the first and second conductive layers separated by a dielectric layer.

20. The reflect away of claim 19, wherein the elements of the first away of phasing elements and the elements of the second array of phasing elements overlap.

* * * * *

UNITED STATES PATENT AND TRADEMARK OFFICE

CERTIFICATE OF CORRECTION

PATENT NO. : 7,623,088 B2
APPLICATION NO. : 11/952799
DATED : November 24, 2009
INVENTOR(S) : Brown It is certified that error appears in the above-identified patent and that said Letters Patent is hereby corrected as shown below:

Column 1, line 56: replace "away" with --array--

Column 1, line 62: replace "away" with --array--

Column 8, line 17: replace "away" with --array--

Column 8, line 38: replace "away" with --array--

Column 8, line 42: replace "away" with --array--

Column 9, line 15: replace "away" with --array--

Column 10, line 1: replace "away" with --array--

Column 10, line 9: replace "reflect away" with --reflect array--

Column 10, line 9: replace "first away" with --first array--

Column 10, line 10: replace "away" with --array--

Column 10, line 14: replace "away" with --array--

Column 10, line 15: replace "away" with --array--

Signed and Sealed this

Fifth Day of January, 2010

David J. Kappos

David J. Kappos
*Director of the United States Patent and Trademark Office*